US010676892B2

(12) United States Patent
Mäkelä

(10) Patent No.: US 10,676,892 B2
(45) Date of Patent: Jun. 9, 2020

(54) REPLACEABLE BLADE PIECE AND BLADE PIECE HOLDER OF A WORKING CYLINDER OF A SCREEN CRUSHER

(71) Applicant: ALLU FINLAND OY, Pennala (FI)

(72) Inventor: Tommi Mäkelä, Pennala (FI)

(73) Assignee: ALLU FINLAND OY, Pennala (FI)

( * ) Notice: Subject to any disclaimer, the term of this patent is extended or adjusted under 35 U.S.C. 154(b) by 0 days.

(21) Appl. No.: 15/770,091

(22) PCT Filed: Oct. 14, 2016

(86) PCT No.: PCT/FI2016/050717

§ 371 (c)(1),
(2) Date: Apr. 20, 2018

(87) PCT Pub. No.: WO2017/068239

PCT Pub. Date: Apr. 27, 2017

(65) Prior Publication Data

US 2018/0313057 A1 Nov. 1, 2018

(30) Foreign Application Priority Data

Oct. 23, 2015 (FI) ..... 20155755

(51) Int. Cl.
*E02F 3/40* (2006.01)
*E02F 3/407* (2006.01)
(Continued)

(52) U.S. Cl.
CPC ..... *E02F 3/407* (2013.01); *B02C 13/2804* (2013.01); *B28D 1/186* (2013.01);
(Continued)

(58) Field of Classification Search
CPC . E02F 3/407; E02F 7/06; E02F 9/2858; E02F 9/2866; E02F 9/2883; B02C 13/2804; B28D 1/186
See application file for complete search history.

(56) References Cited

U.S. PATENT DOCUMENTS 1,940,116 A * 12/1933 Brooks ..... B02C 13/28 241/197
2,015,581 A * 9/1935 Armour ..... B02C 13/28 241/195
(Continued)

FOREIGN PATENT DOCUMENTS

EP 1 780 375 5/2007
EP 2 687 639 1/2014
(Continued)

*Primary Examiner* — Jamie L McGowan
(74) *Attorney, Agent, or Firm* — Womble Bond Dickinson (US) LLP

(57) ABSTRACT

The invention relates to a replaceable blade piece of a working cylinder of a screen crusher. A blade piece—has a frame portion and a blade portion, the longitudinally opposite front surfaces of which form work surfaces. The frame portion has a through hole extending in the longitudinal direction of the blade portion. A channel-like section is formed on opposite sides of the frame portion containing the hole and extends in the vertical direction of a frame portion, between the edge areas of the side with the hole. The invention further relates to a replaceable blade piece holder having a U-shaped frame portion including arm portions, through which extends a longitudinal hole of the frame portion, and a bottom portion. On the opposite surfaces of the arm portions, onto their middle area is formed a bulge, which extends in the vertical direction of the arm portion.

7 Claims, 5 Drawing Sheets

Figure 1:
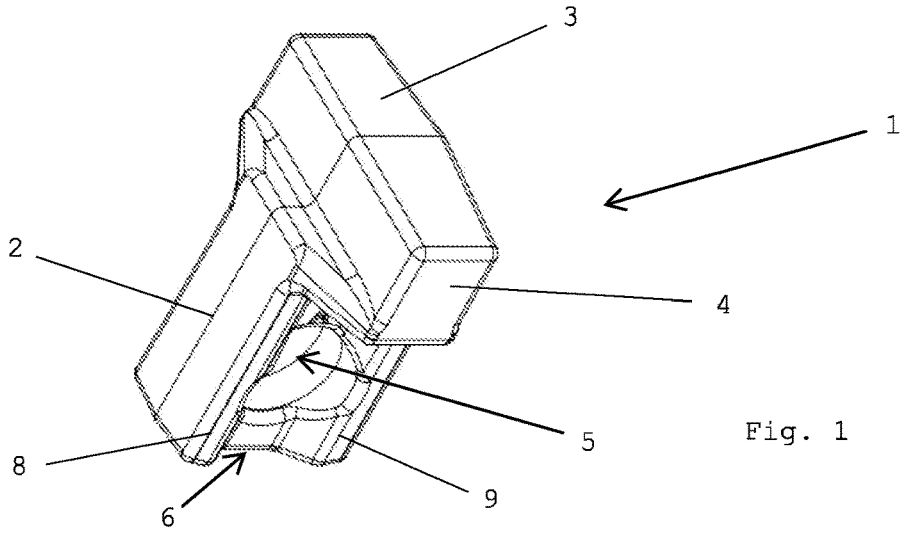

(51) Int. Cl.

| | |
|---|---|
| ***B28D 1/18*** | (2006.01) |
| ***E02F 7/06*** | (2006.01) |
| ***E02F 9/28*** | (2006.01) |
| ***B02C 13/28*** | (2006.01) |

(52) U.S. Cl.
CPC ..... *E02F 7/06* (2013.01); *E02F 9/2858* (2013.01); *E02F 9/2866* (2013.01); *E02F 9/2883* (2013.01)

(56) References Cited

U.S. PATENT DOCUMENTS 2,183,880 A * 12/1939 Brooks ..... B02C 13/28 241/197
2,460,279 A * 2/1949 Ehmann ..... B02C 13/28 241/194
2,620,989 A * 12/1952 Keiper ..... B02C 13/28 241/197
3,207,448 A * 9/1965 Miller ..... B02C 13/28 241/197
3,322,356 A * 5/1967 Toews ..... B02C 13/28 241/197
3,545,691 A * 12/1970 Arsenault ..... B02C 13/28 241/197
4,060,961 A * 12/1977 Anderson ..... A01D 34/535 241/194
4,406,415 A * 9/1983 Greer ..... B02C 13/20 241/194
6,971,598 B2 * 12/2005 Schillinger ..... B02C 13/28 241/194
7,559,497 B2 * 7/2009 Young ..... B02C 13/04 241/194
D616,002 S * 5/2010 Willibald ..... D15/139
7,753,302 B2 * 7/2010 Zollig ..... B02C 13/14 241/195
D637,632 S * 5/2011 Schmitz ..... B02C 13/28 D15/123
D700,920 S * 3/2014 DeVitis ..... D15/123
9,855,560 B2 * 1/2018 Graf ..... B02C 13/04
2009/0159732 A1 6/2009 Zöllig
2009/0174252 A1 7/2009 Morris et al.
2012/0018560 A1 1/2012 Denis et al.

FOREIGN PATENT DOCUMENTS

SU 942793 7/1982
WO WO 2006/079207 8/2006

* cited by examiner

REPLACEABLE BLADE PIECE AND BLADE PIECE HOLDER OF A WORKING CYLINDER OF A SCREEN CRUSHER

CROSS-REFERENCE TO RELATED APPLICATIONS

This application is a national stage filing under 35 U.S.C. § 371 of PCT/FI2016/050717, filed Oct. 14, 2016, which claims priority from Finnish Application No. 20155755, filed on Oct. 23, 2015, which applications are hereby incorporated in their entirety by reference in this application.

The present invention relates to a replaceable blade piece of a working cylinder of a screen crusher, which as viewed from the side is substantially T-shaped, said blade piece having a frame portion forming the vertical shaft of the T and a blade portion forming the horizontal arm of the T, the longitudinally opposite front surfaces of which form the actual work surfaces, said frame portion having a through hole extending in the longitudinal direction of the blade portion. The invention further relates to a replaceable blade piece holder of a working cylinder of a screen crusher, said holder having a U-shaped frame portion comprising arm portions, through which extends a longitudinal hole of the frame portion, and a bottom portion with a curved bottom connecting the arm portions.

The object of the present invention is to provide an improved blade piece and blade piece holder of a screen crusher. Such replaceable blade pieces are used, for example, in connection with the working cylinder of a screen crusher described in patent U.S. Pat. No. 7,506,461B2. As viewed from the side, the blade pieces are substantially T-shaped, and they are placed in U-shaped holders such that the blade portion forming the horizontal arm portion of the blade piece settles in the longitudinal direction of the holder on top of the arm portions in the holder. The through hole in the blade piece settles into alignment with the through hole in the holder, and the blade piece is locked into the holder with a locking pin or corresponding locking element extending through the holes of the blade piece and the holder.

In these blade pieces and holders of known art, their opposite surfaces of the vertical shaft of the blade piece and of the arms of the holder are flat and the hole in them causes relatively great cutting forces to be directed to the locking element during the use of the screen crusher. In blade pieces and their holders of known art, problems have been observed in practise, i.a. in terms of their durability and replaceability.

The object of the present invention is thus to provide a solution, which decreases the loads directed to the locking elements and thus decreases the need for servicing and the resulting downtimes and further improves the replaceability of the blade pieces.

In order to achieve this object, a blade piece according to the invention is characterized in that into the frame portion is formed, on the opposite sides containing the hole, a channel-like section, which extends in the vertical direction of the frame portion, between the edge areas of the side with the hole. A blade piece holder according to the invention is characterized in that, on the opposite surfaces of the arm portions, onto their middle area is formed a bulge, which extends in the vertical direction of the arm portion, travelling at the hole.

Figure 2:
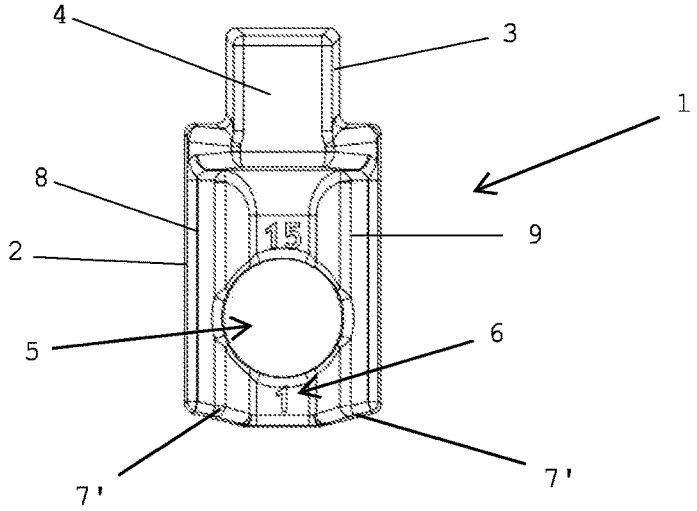
Figure 3:
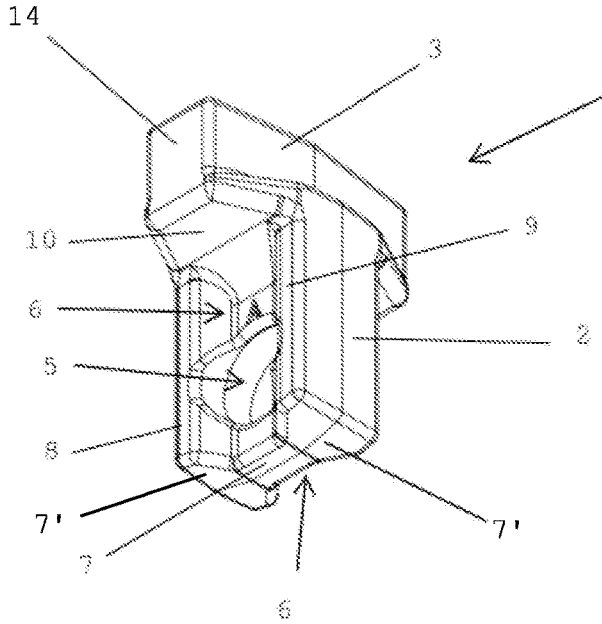
Figure 4:
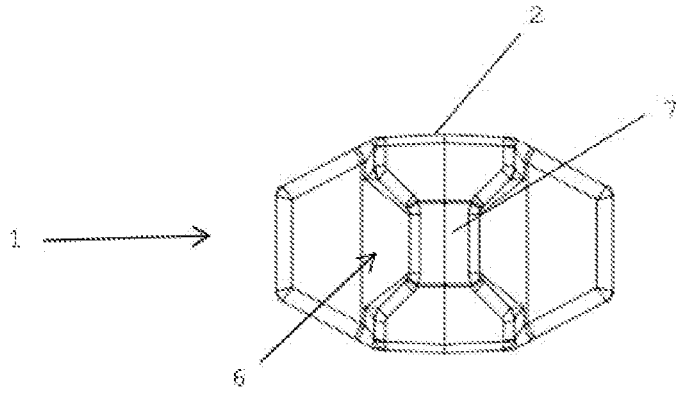
Figure 5:
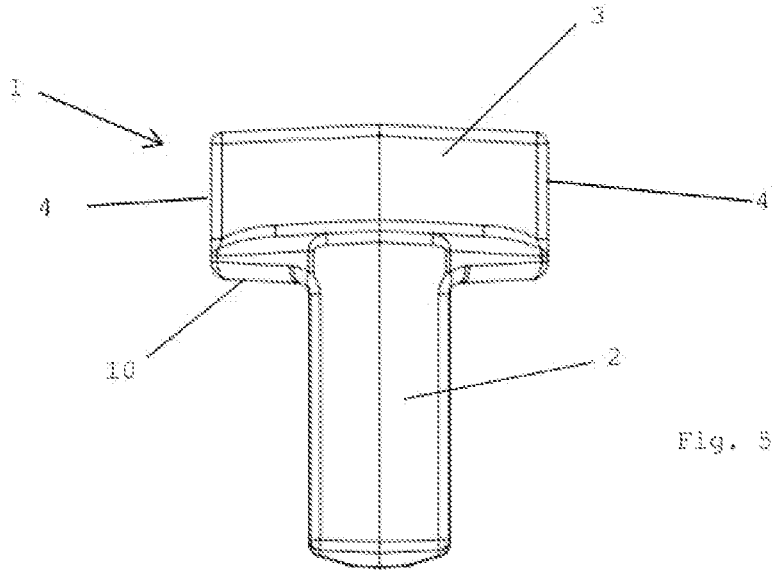
Figure 6:
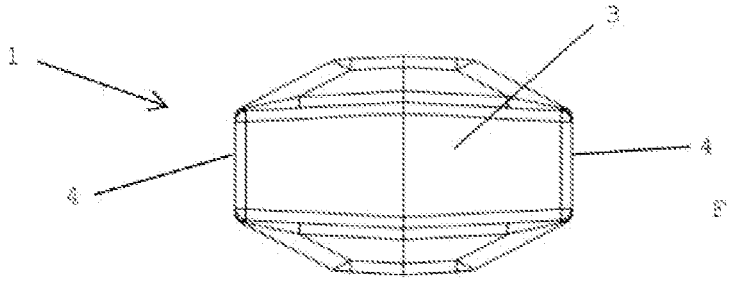
Figure 7:
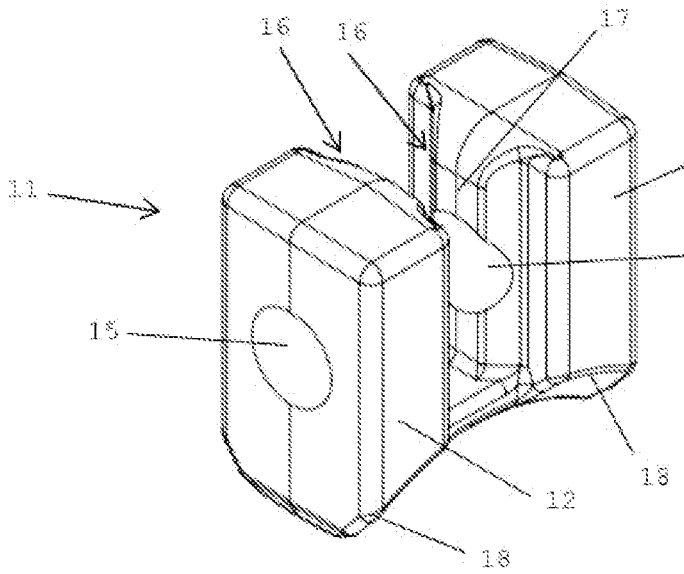
Figure 8:
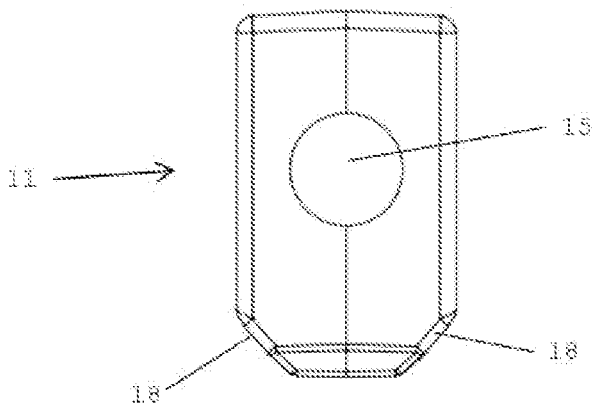
Figure 9:
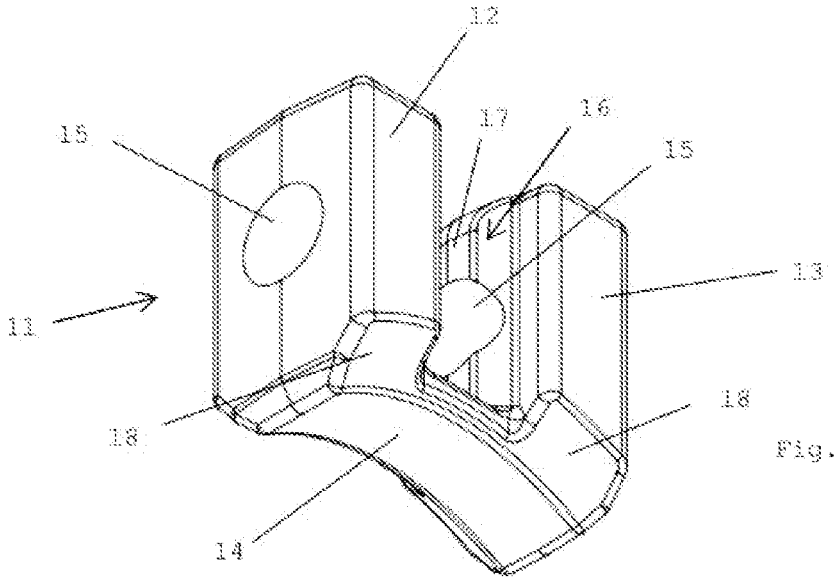
Figure 10:
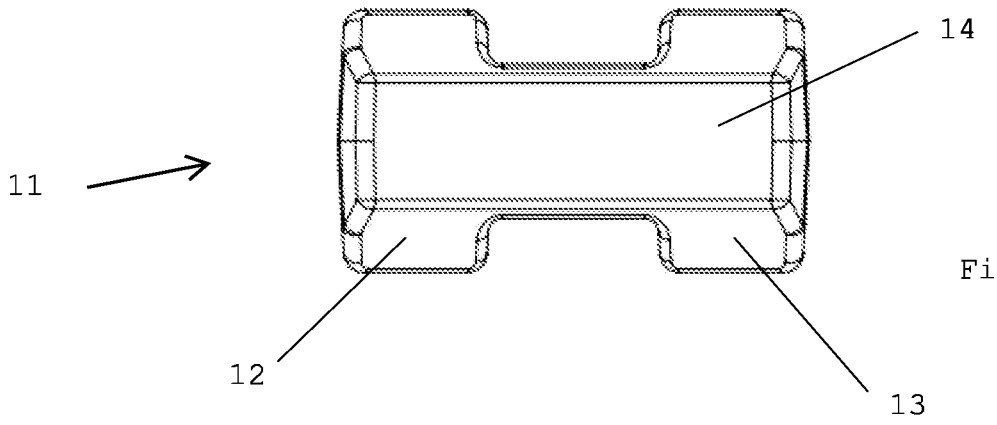
Figure 11:
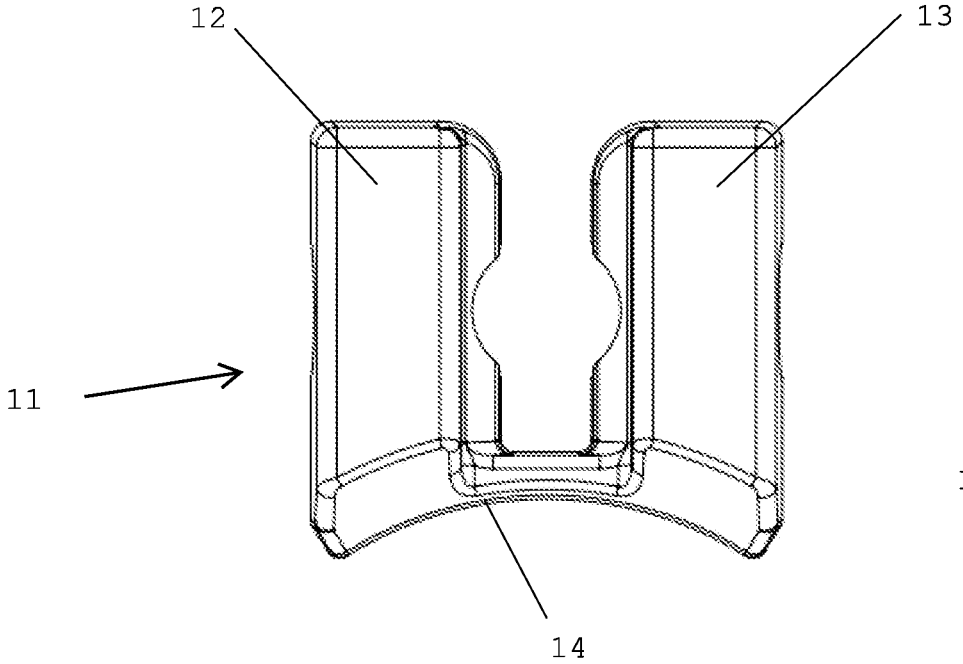
Figure 12:
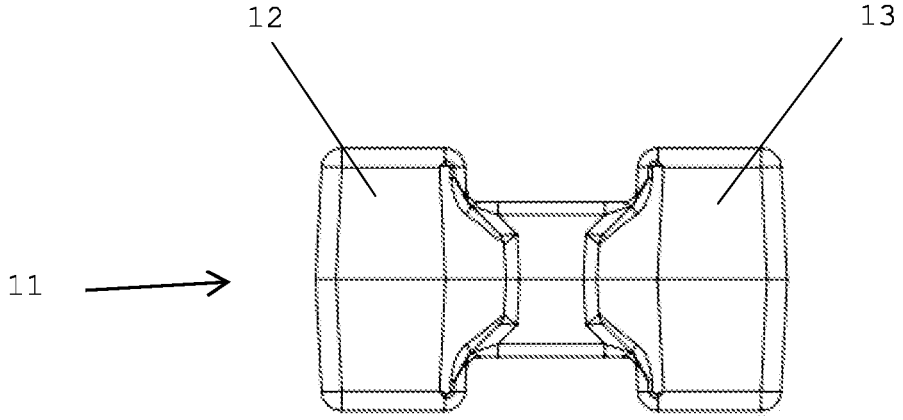
Figure 13:
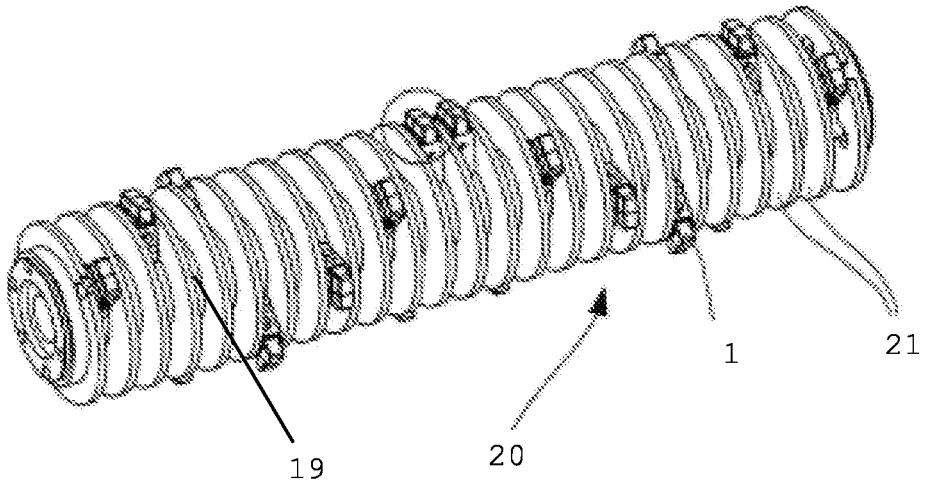

In the following, the invention is described in more detail with reference to the accompanying figures, in which:

FIGS. 1-3 show a preferred embodiment of a blade piece according to the invention diagrammatically as an oblique view seen from above, as a view seen from directly in front and as an oblique view seen from below, respectively, FIGS. 4-6 show the blade piece of FIGS. 1-3 correspondingly as a view seen from below, as a view seen from the side and as a view seen from above, FIGS. 7-9 show a preferred embodiment of a blade piece holder according to the invention diagrammatically as an oblique view seen from above, as a view seen directly in front and as an oblique view seen from below, respectively, FIGS. 10-12 show the holder of FIGS. 7-9 correspondingly as a view seen from below, as a view seen from the side and as a view seen from above, and FIG. 13 shows an example of a working cylinder of a screen crusher according to prior art, in which a blade piece with its holder according to the invention can be used.

The blade piece 1 shown in FIGS. 1-6 comprises a T-shaped body having a frame portion 2 forming the vertical shaft of the T and a blade portion 3 forming the horizontal arm of the T, the opposing longitudinal front surfaces of which form the actual work surfaces 4. The frame portion 2 has, extending in the longitudinal direction of the blade portion 3, a through hole 5 receiving the locking element (not shown).

The blade piece holder 11 shown in FIGS. 7-12 comprises a U-shaped frame having arm portions 12 and 13 and connecting these a bottom portion 14, which is shaped as curved at its lower surface. The holder 11 is preferably connected by welding, for example, to the axis 19 of the working cylinder 20 shown in FIG. 13, between the screening discs 21 that are at an axial distance from each other, wherein the holder settles longitudinally in the circumferential direction of the axis 19. The curvature of the bottom portion of the holder corresponds substantially to the curvature of the outer surface of the axis 19. The holders are placed at the desired sites in the circumferential direction of the axis 19, adjacent holders being preferably at different circumferential sites on the axis.

The arms 12, 13 of the holder have a hole 15 going through them which receives the locking element (not shown) and extends in the longitudinal direction of the holder. The blade pieces 1 are placed in the holder such that the hole 5 of the blade piece settles into alignment with the holes 15 of the corresponding holder 11 and are locked into place with a locking pin or corresponding locking element (not shown). In this case, the blade portion 3 of the blade piece 1 settles on top of the arms 12, 13 of the holder, the front surface 4 of the blade portion facing towards the rotational direction of the working cylinder. The frame portion 2 of the blade piece 1 and the lower surface 10 of the blade portion 3 are substantially at a 90 degree angle to each other with a smaller radius of curvature than earlier, making the edge site nearly sharp. In this case, the blade piece is also suitable for use in existing holders.

The radial extension of the blade pieces 1 is greater than the extension of the screening discs 21, and the working cylinder 20 is placed next to the other working cylinder (not shown) of the screen crusher close enough to each other that the screening discs 21 nearly touch (or touch) each other, wherein the blade pieces 1 fall between the screening discs of the adjacent working cylinder.

The use of such blade pieces in the working cylinders of a screen crusher is known, for example, from above said patent publication U.S. Pat. No. 7,506,461B2.

Into the frame portion 2 of a blade piece according to the invention, on the opposite sides containing the hole 5, is formed a channel-like section 6, which extends in the vertical direction of the frame portion 2, between the edge areas 8, 9 of the side with the hole. The hole 5 is located substantially within the channel-like section. The channel-like section has a flat bottom, wherein between the bottoms of the channel-like sections of opposite sides is formed a substantially uniformly thick ridge 7. Onto the inner surface of the arms 12, 13 of the holder 11 is formed a bulge 16 to be placed into cooperation with the channel-like section of the blade piece 1, said bulge extending in the vertical direction of the arm portion, travelling at the hole 15. The bulge 16 has a substantially flat outermost surface 17 corresponding substantially to the flat bottom of the channel-like section 6 of the blade piece. When a blade piece 1 is placed into the holder 11, the channel-like section 6 and the bulge 16 form a form locking, serving to reduce the stresses directed to the locking element.

In order to facilitate replacement of a blade piece 1, into the lower edge of the sides without holes is formed a bevel 7', which extends to the ridge 7. In this case, the tool (not shown) to be used to remove a blade piece is more easily made to settle between the lower surface of the blade piece and the holder for prying the blade piece off from the holder. Bevels 18 are also formed into the lower portion of the sides without holes in the arms 12, 13 of the holder, which provides for that the blade holder can be positioned tightly against the surface of the cylinder pipe between the screening discs. The bevels skirt the welding seam of the screening discs, enabling good compatibility.

The invention claimed is:

1. A replaceable blade piece of a working cylinder of a screen crusher, which blade piece, as viewed from the side is substantially T-shaped, said blade piece having a frame portion forming a vertical shaft of the T and a blade portion forming a horizontal arm of the T, longitudinally opposite front surfaces of which form actual work surfaces, said frame portion having a through hole extending in a longitudinal direction of the blade portion, the blade portion longitudinally extending in use in a rotational direction of the working cylinder, wherein into the frame portion is formed, on opposite sides in the rotational direction of the working cylinder between and through which sides the hole extends, a channel section, which extends in a vertical direction of the frame portion, between lateral edge areas of the side with the hole.

2. The blade piece according to claim 1, wherein the hole is located at least primarily within the channel section.

3. The blade piece according to claim 1, wherein the channel section has a substantially flat bottom, wherein between the bottoms of the channel sections of opposite sides is formed a substantially uniformly thick ridge.

4. The blade piece according to claim 1, wherein the frame portion and a lower surface of blade portion are substantially at a 90 degree angle to each other with a small radius of curvature.

5. The blade piece according to claim 1, wherein into the lower edge of the side without a hole in the frame portion is formed a bevel.

6. A holder for the blade piece according to claim 1, having a U-shaped frame portion extending in use longitudinally in a circumferential direction of an axis of a working cylinder of a screen crusher, the frame portion comprising arm portions, through which extends a longitudinal hole of the frame portion in the longitudinal direction of the holder, and a bottom portion with a curved bottom connecting the arm portions, wherein, on the opposite surfaces of the arm portions, onto their middle area is formed a bulge, which extends in the vertical direction of the arm portion, travelling at the hole.

7. The holder according to claim 6, wherein the bulge has a substantially flat outermost surface.

* * * * *